US006478601B2

(12) United States Patent
Oswald

(10) Patent No.: US 6,478,601 B2
(45) Date of Patent: Nov. 12, 2002

(54) CORD CONNECTOR

(76) Inventor: Robert L. Oswald, 416 N. Quince St., Shickley, NE (US) 68436

( * ) Notice: Subject to any disclaimer, the term of this patent is extended or adjusted under 35 U.S.C. 154(b) by 0 days.

(21) Appl. No.: 10/012,183

(22) Filed: Dec. 4, 2001

(65) Prior Publication Data

US 2002/0090857 A1 Jul. 11, 2002

Related U.S. Application Data

(60) Provisional application No. 60/251,461, filed on Dec. 5, 2000.

(51) Int. Cl.[7] ..... H01R 13/62
(52) U.S. Cl. ..... 439/369
(58) Field of Search ..... 439/369, 371

(56) References Cited

U.S. PATENT DOCUMENTS 5,129,839 A * 7/1992 VanSkiver ..... 439/369
5,443,397 A * 8/1995 Carl ..... 439/369
5,782,649 A * 7/1998 Aiken ..... 439/369
6,196,859 B1 * 3/2001 Garlarza ..... 439/369

* cited by examiner

*Primary Examiner*—Gary F. Paumen

(57) ABSTRACT

A cord connector includes an elongated tubular body having first and second opposing closed ends and a sidewall extending between the ends, the body cut in half longitudinally to form an upwardly open channel. A slot is formed in each end, extending radially inwardly from an exterior edge, and an end cap is operably mounted on each end of the tubular body. The caps have slots formed therein extending radially inwardly from an exterior edge and are operably mounted for movement between a receiving position with the cap slot aligned with corresponding body end slot, and a locked position with the cap slot misaligned relative to the corresponding body end slot.

14 Claims, 4 Drawing Sheets

CORD CONNECTOR

CROSS-REFERENCES TO RELATED APPLICATIONS

Applicant claims the benefit of the filing date of Provisional Patent Application Ser. No. 60/251,461 filed Dec. 5, 2000, entitled CORD CONNECTOR.

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to a connector for retaining and holding an electrical cord, and more particularly to an improved cord connector which retains the ends of two electrical extension cords in plugged relationship.

(2) Background Information

There have been many connectors devised for retaining the ends of electrical cords in plugged relationship, but all suffer the same general problem. More specifically, prior art cord connectors typically require that the connector be applied to one or both plug ends before the cords ends are plugged together. In the same way, prior art connectors also typically require that the cord ends be disconnected before removing the cord connector.

Another problem with several prior art connectors, is that the connector completely encloses the plugged ends of the cords, thereby preventing direct viewing of the connection, to insure that the ends are indeed connected within the connector.

BRIEF SUMMARY OF THE INVENTION

It is therefore a general object of the present invention to provide an improved electrical cord connector.

Another object of the present invention is to provide an improved cord connector which may be attached to the ends of two electrical cords after the cords have been connected to one another.

A further object is to provide an improved cord connector which permits direct viewing of the connected cords, while retained within the connector.

Yet another object is to provide an improved cord connector which is simple and economical to manufacture, and simple to use.

These and other objects of the present invention will be apparent to those skilled in the art.

The cord connector of the present invention includes an elongated tubular body having first and second opposing closed ends and a sidewall extending between the ends, the body cut in half longitudinally to form an upwardly open channel. A slot is formed in each end, extending radially inwardly from an exterior edge, and an end cap is operably mounted on each end of the tubular body. The caps have slots formed therein extending radially inwardly from an exterior edge and are operably mounted for movement between a receiving position with the cap slot aligned with corresponding body end slot, and a locked position with the cap slot misaligned relative to the corresponding body end slot.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
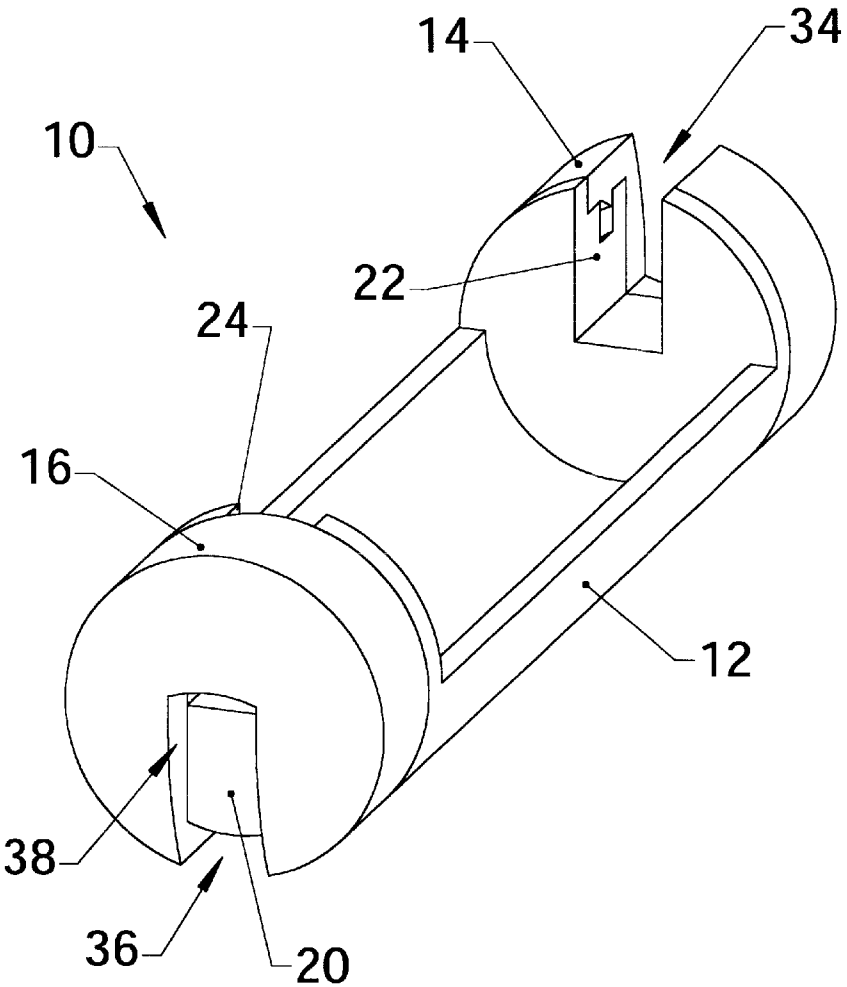
FIG. 1 is a pictorial view of the invention.

Referring now to the drawings, in which similar or corresponding parts are identified with the same reference numeral, and more particularly to FIG. 1, the cord connector of the present invention is designated generally at 10, and includes a main body 12 with a pair of rotational end pieces 14 and 16 on each end of body 12.

Figure 2:
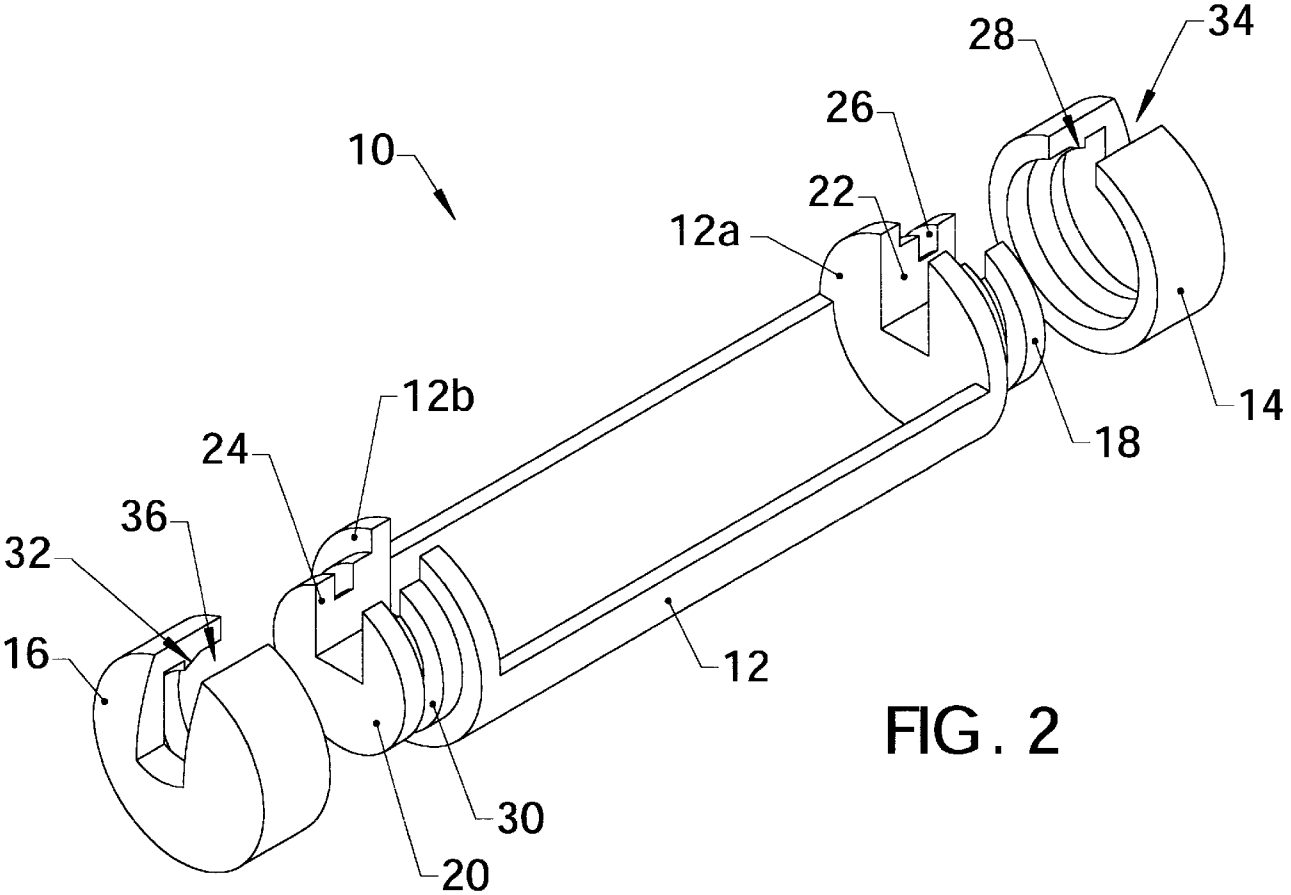
FIG. 2 is an exploded pictorial view of the invention.
Figure 3:
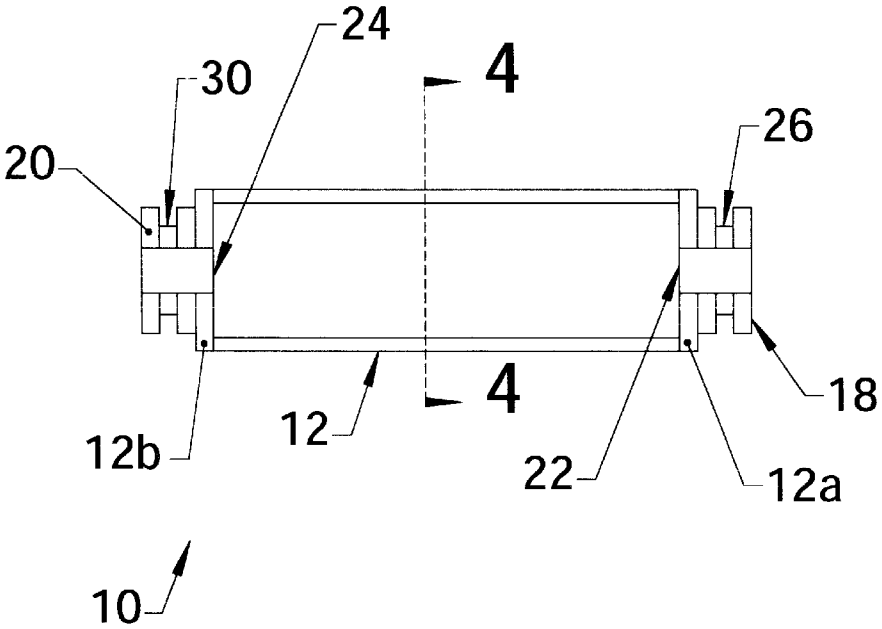
FIG. 3 is a plan view of the main body of the invention.
Figure 4:
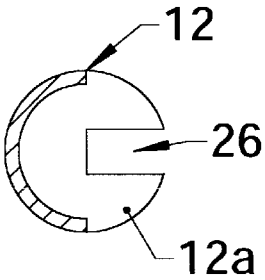
FIG. 4 is a sectional view taken at lines A—A in FIG. 3.

As shown in FIG. 2, body 12 is a tubular member that is cut in half longitudinally to form a channel. This channel will receive the male and female ends of a pair of electrical extension cords (not shown), and retain them in plugged relationship. Each end 12*a* and 12*b* of body 12 includes a generally cylindrical hub 18 and 20, respectively. Each hub 18 and 20 has a slot 22 and 24, respectively, extending radially inwardly from a perimeter edge to a point past the center of the hub. These slots 22 and 24 will receive the electrical cords therein, with the plug ends located inwardly of the hubs 18 and 20, within the channel.

An annular groove 26 is formed around the perimeter of hub 18, in a plane normal to the longitudinal axis of the body 12, to receive a tooth 28 formed on the interior surface of end cap 14, as described in more detail hereinbelow. Similarly, hub 20 has an annular groove 30 for receiving a tooth 32 on end cap 16.

Figure 6:
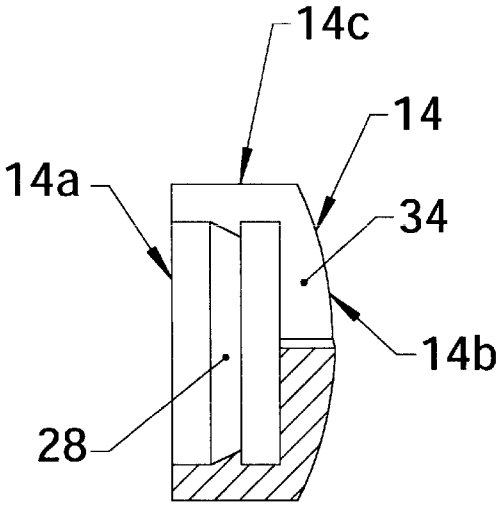
FIG. 6 is a sectional view of the end piece taken at lines 6—6 in FIG. 5.
Figure 5:
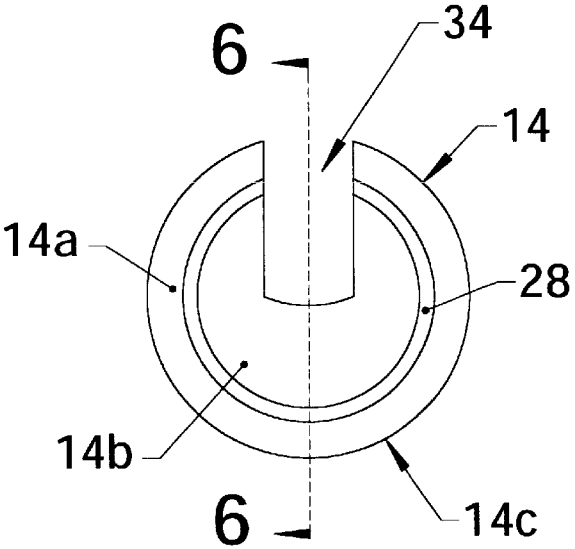
FIG. 5 is a front elevational view of one of the two rotational end pieces.

Referring now to FIGS. 2, 5 and 6, end caps 14 and 16 are identical, so only end cap 14 will be described in detail. End cap 14 is a hollow tubular member with an open end 14*a* and a closed end 14*b* connected by cylindrical wall 14*c*. A slot 34 extends longitudinally through wall 14*c* from the open end 14*a* to the closed end 14*b*, and radially inward from the outer edge of the closed end 14*b* past the center thereof, to correspond with the slot 22 in hub 18. This slot 34 serves the same function as slot 22 in hub 18, to retain an electrical cord within the slot.

Tooth 28 is an annular rib that slopes radially inwardly from the inward end (proximal the cap open end 14*a*) to the outward end (proximal the cap closed end 14*b*). This tooth 28 will engage the groove 26 of hub 18 to permit slidable rotation of the cap 14 on the end of hub 18 about the longitudinal axis of the cap 14 and hub 18, while preventing the cap 14 from coming off the end of hub 18.

End cap 16 includes the same open end 16*a*, closed end 16*b*, side wall 16*c* and slot 36, as those described with respect to end cap 14. An annular tooth 32 will engage groove 30 in hub 20 to permit slidable rotation of cap 16 on hub 20.

Referring once again to FIG. 1, end caps are snapped onto the hubs 18 and 20 such that teeth 28 and 32 slidably engage grooves 26 and 30 respectively. As the caps 14 and 16 are rotated, slots 34 and 36 in the end caps will be selectively aligned with the slots 22 and 24 of the hubs, respectively, to permit entry of an electrical cord. This alignment is shown at the right end of body 12 in FIG. 1, with slot 34 aligned with slot 22.

End cap 16 has been rotated in FIG. 1, so that slot 36 is misaligned from slot 24 in hub 20. Because the slots extend past the centers of the caps and hubs, a central aperture 38 is formed between the bottoms of the misaligned slots, to thereby retain an electrical cord therein. The enlarged ends of the male and female plugs of the electrical cord will prevent the connected plugs from being pulled apart through the misaligned slots.

Whereas the invention has been shown and described in connection with the preferred embodiment thereof, many modifications, substitutions and additions may be made which are within the intended broad scope of the appended claims.

What is claimed is:

1. A cord connector, comprising;

an elongated tubular body having first and second opposing closed ends and a sidewall extending between the ends, said body having an upwardly open channel;

a slot formed in each end, extending radially inwardly from an exterior edge thereof;

an end cap operably mounted on each end of the tubular body;

each cap having a slot formed therein extending radially inwardly from an exterior edge thereof;

each cap operably mounted for movement between a receiving position with the cap slot aligned with corresponding body end slot, and a locked position with the cap slot misaligned relative to the corresponding body end slot.

2. The cord connector of claim 1, wherein said body is generally cylindrical in shape.

3. The cord connector of claim 2, wherein each end of the body includes a generally cylindrical hub projecting longitudinally outwardly therefrom, and wherein each cap is operably mounted on a hub.

4. The cord connector of claim 3, wherein each slot in the body extends beyond the center of the body.

5. The cord connector of claim 4, wherein each cap slot extends beyond the center of the cap.

6. The cord connector of claim 5, including means for operably retaining the caps on the hubs.

7. The cord connector of claim 6, wherein said means for retaining the caps on the hubs includes an annular groove formed in each hub and annular tooth formed in each cap for operable engagement therebetween.

8. The cord connector of claim 7, wherein each cap is a generally cylindrical, hollow tubular member with an open end, a closed end, and a side wall extending therebetween, the tooth extends radially inwardly from the sidewall and is sloped radially inwardly from an edge adjacent the open end of the cap to an edge adjacent the closed end of the cap.

9. The cord connector of claim 1, wherein each end of the body includes a generally cylindrical hub projecting longitudinally outwardly therefrom, and wherein each cap is operably mounted on a hub.

10. The cord connector of claim 1, wherein each slot in the body extends beyond the center of the body.

11. The cord connector of claim 1, wherein each cap slot extends beyond the center of the cap.

12. The cord connector of claim 9, including means for operably retaining the caps on the hubs.

13. The cord connector of claim 12, wherein said means for retaining the caps on the hubs includes an annular groove formed in each hub and annular tooth formed in each cap for operable engagement therebetween.

14. The cord connector of claim 13, wherein each cap is a generally cylindrical, hollow tubular member with an open end, a closed end, and a side wall extending therebetween, the tooth extends radially inwardly from the sidewall and is sloped radially inwardly from an edge adjacent the open end of the cap to an edge adjacent the closed end of the cap.

* * * * *